US009590358B2

(12) United States Patent
Goh et al.

(10) Patent No.: US 9,590,358 B2
(45) Date of Patent: Mar. 7, 2017

(54) ELECTRICAL CONNECTOR HAVING STAGGERED PINS

(71) Applicant: Molex, LLC, Lisle, IL (US)

(72) Inventors: Siow Pheng Goh, Singapore (SG); Yoke Wai Cheah, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/430,776

(22) PCT Filed: Sep. 27, 2013

(86) PCT No.: PCT/IB2013/002143

§ 371 (c)(1),
(2) Date: Mar. 24, 2015

(87) PCT Pub. No.: WO2014/049426

PCT Pub. Date: Apr. 3, 2014

(65) Prior Publication Data

US 2015/0255927 A1 Sep. 10, 2015

(30) Foreign Application Priority Data

Sep. 28, 2012 (CN) ..... 2012 1 0368060
Sep. 28, 2012 (CN) ..... 2012 2 0501543 U

(51) Int. Cl.
*H01R 24/60* (2011.01)
*H01R 13/6471* (2011.01)
(Continued)

(52) U.S. Cl.
CPC ..... *H01R 13/6471* (2013.01); *H01R 12/716* (2013.01); *H01R 12/585* (2013.01); *H01R 24/60* (2013.01); *H01R 2107/00* (2013.01)

(58) Field of Classification Search
CPC H01R 13/646; H01R 13/616; H01R 13/6471; H01R 12/7222; H01R 12/51; H01R 12/716; H01R 12/585
(Continued)

(56) References Cited

U.S. PATENT DOCUMENTS 3,643,201 A * 2/1972 Harwood ..... H01R 23/688 333/238
5,215,473 A 6/1993 Brunker et al.
(Continued)

FOREIGN PATENT DOCUMENTS

WO WO 2010/111379 A2 9/2010

*Primary Examiner* — Amy Cohen Johnson
*Assistant Examiner* — Milagros Jeancharles
(74) *Attorney, Agent, or Firm* — Clarence R. Moon

(57) ABSTRACT

An electric connector includes a first pair of differential signal terminals, a second pair of differential signal terminals, a first ground terminal, a second ground terminal and a third ground terminal. The first signal terminal and the second signal terminal of the first pair of differential signal terminals and the third signal terminal and the fourth signal terminal of the second pair of differential signal terminals are arranged in a first direction in sequence. The pins of the first pair of differential signal terminals are staggered in a second direction transverse to the first direction and the second pair of differential signal terminals are staggered in a second direction transverse to the first direction. The electric connector according to the disclosure can reduce electromagnetic radiation.

9 Claims, 8 Drawing Sheets

(51) Int. Cl.
*H01R 12/71* (2011.01)
*H01R 107/00* (2006.01)
*H01R 12/58* (2011.01)

(58) Field of Classification Search
USPC ..... 439/676, 660, 76.1, 626, 629, 630, 59, 439/260, 267, 325, 377
See application file for complete search history.

(56) References Cited

U.S. PATENT DOCUMENTS

| | | | | |
|---|---|---|---|---|
| 6,305,987 | B1 | 10/2001 | Crane et al. | |
| 6,942,524 | B2 * | 9/2005 | Wu | H01R 12/716 439/62 |
| 7,101,225 | B2 | 9/2006 | Kohler | |
| 7,410,392 | B2 * | 8/2008 | Szczesny | H01R 12/585 439/108 |
| 8,231,411 | B1 * | 7/2012 | Westman | H01R 13/6471 439/108 |
| 8,672,691 | B2 * | 3/2014 | Kondo | H01R 13/6471 439/108 |
| 8,702,451 | B2 * | 4/2014 | Luo | H01R 12/725 439/607.28 |
| 8,747,164 | B2 * | 6/2014 | Westman | H01R 12/721 439/60 |
| 2004/0097112 | A1 | 5/2004 | Minich et al. | |
| 2010/0255731 | A1 * | 10/2010 | Oyake | H01R 13/65802 439/660 |
| 2012/0115371 | A1 * | 5/2012 | Chuang | H01R 12/724 439/660 |

* cited by examiner

ELECTRICAL CONNECTOR HAVING STAGGERED PINS

RELATED APPLICATIONS

This application claims priority to Chinese Application No. 201210368060.X, filed Sep. 28, 2012 and Chinese Application No. 201220501543.8, filed Sep. 28, 2012, both of which are incorporated herein by reference in their entirety.

TECHNICAL FIELD

The disclosure relates to an electric connector in particular to a connector used in a computer.

BACKGROUND ART

Serial attached SCSI (SAS) is a communication protocol which mainly used to standardize data access of a computer storage device (such as a hard disk or a tape drive, etc.). SAS is a point-to-point serial protocol for replacing the parallel SCSI bus technology promoted in the mid 1980's. The SAS device uses differential signals to allow communication. The differential signals can reduce negative effects, such as capacity effect, inductance effect, noise and so on, which the parallel SCSI suffers under high-speed communication transmission, and achieves a stable and high-speed serial communication.

The SAS succeeds to the frame formats and full-duplex communication of the standard 15 SCSI command set and the fiber channel protocol. Each SAS device includes at least a transceiver mechanism, which includes a transmitter and a receiver. Two pair of conductive wires can be used to connect the transmitters and corresponding receivers in connecting ports of two devices. Under the full-duplex communication, each transceiver mechanism can transmit and receive data via the two pairs of conductive wires.

The connecting ports of the two devices can be connected to a connector via connecting wires. Two pairs of conducting wires may be connected to two pairs of terminals on the connector, respectively. The physical link rate of the first-generation SAS is 3.0 Gbps (Gbit/s), and the second-generation SAS, whose physical link rate is twice as much as the first-generation SAS and up to 6.0 Gbps, is the main trend currently. In the near future, the third-generation SAS may be promoted, and its physical link rate will further increase to be twice as much as the second-generation SAS and up to 12 Gbps. Since the arrangement of the terminal pins of the third-generation SAS is the same as that of the second-generation SAS, when the physical link rate increases to 12 Gbps, some problems that the current connectors may have is electromagnetic interference (EMI emission), the two pairs of terminals may have cross-talking, and so on, may be faced.

SUMMARY OF THE INVENTION

The disclosure, In view of the problems above, a novel electric connector is provided.

An electric connector according to an embodiment of the disclosure comprises an insulating body and a first set of terminals. The first set of terminals includes a first pair of differential signal terminals, a second pair of differential signal terminals, a first ground terminal, a second ground terminal and a third ground terminal. The first pair of differential signal terminals is fixed to the insulating body.

The first pair of differential signal terminals may be fixed to the insulating body, and may include a first signal terminal and a second signal terminal. The first signal terminal and the second signal terminal may include a pin, respectively. The second pair of differential signal terminals may be fixed to the insulating body and may include a third signal terminal and a fourth signal terminal. The third signal terminal and the fourth signal terminal may include a pin, respectively. The first signal terminal, the second signal terminal, the third signal terminal and the fourth signal terminal are arranged in a first direction in sequence.

The pins of the first pair of differential signal terminals are staggered in a second direction transverse to the first direction. The pins of the second pair of differential signal terminals are staggered in a direction transverse to the second direction. The first ground terminal is adjacent to the first signal terminal. The first ground terminal may include at least a pin, and the pin is close to the pin of first signal terminal. The second ground terminal is disposed between the second signal terminal and the third signal terminal and may include a first pin and a second pin. The first pin is close to the pin of third signal terminal and the second pin is close to the pin of the second signal terminal. The third ground terminal is adjacent to the fourth signal terminal. The third ground terminal may include at least a pin, which is close to the pin of the fourth signal terminal.

Since the pin of the first ground terminal is close to the pin of the first signal terminal, a pin of the second ground terminal is close to the pin of the second signal terminal and another pin of the second ground terminal is close to another pin of the third signal terminal, and the pin of the third ground terminal is close to the pin of the fourth signal terminal, the electromagnetic radiation may be reduced.

BRIEF DESCRIPTION OF THE DRAWINGS

This application is illustrated by way of example and not limited in the accompanying figures in which like reference numerals indicate similar elements and in which.

DETAILED DESCRIPTION OF THE PREFERRED EMBODIMENTS

FIGS. 1-8 illustrate an embodiment of the disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously practice the disclosure. Exemplary embodiments of the disclosure will now be described in more detail with reference to the accompanying drawings.

Figure 1:
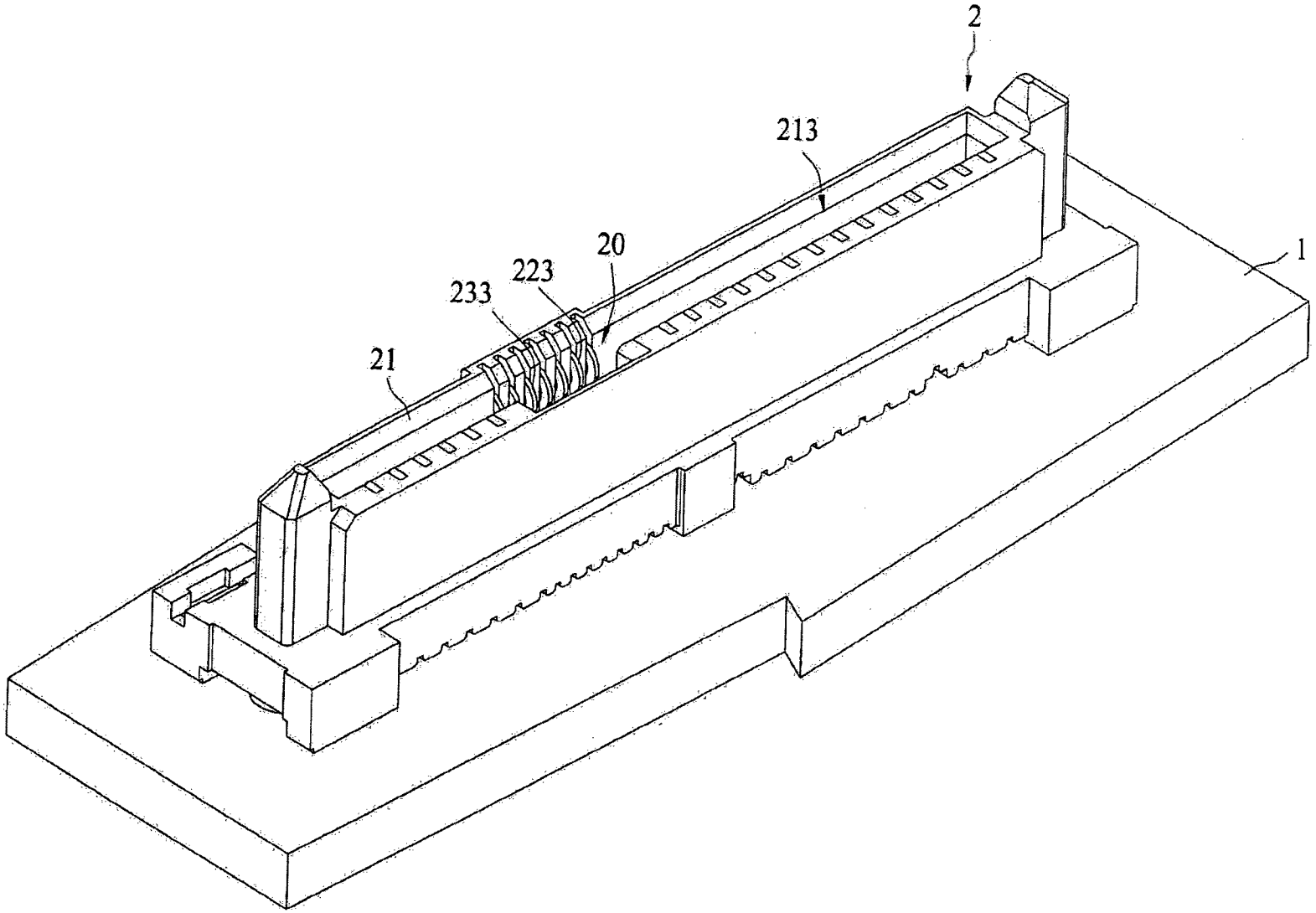
FIG. 1 is a schematic diagram showing an embodiment of the disclosure, illustrating an electric connector installed on a circuit board.
Figure 2:
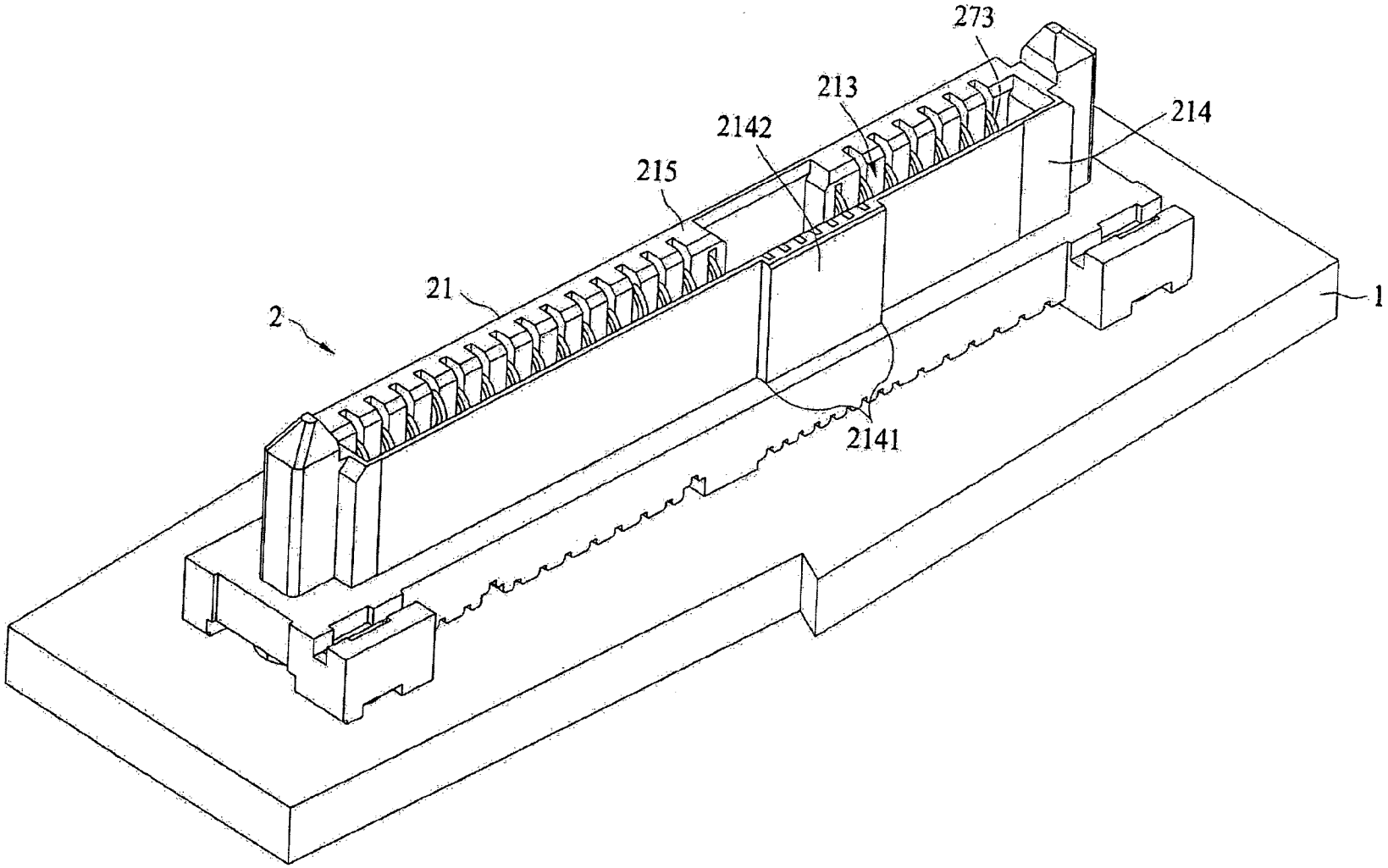
FIG. 2 is another schematic diagram showing an embodiment of the disclosure, illustrating an electric connector installed on a circuit board.
Figure 3:
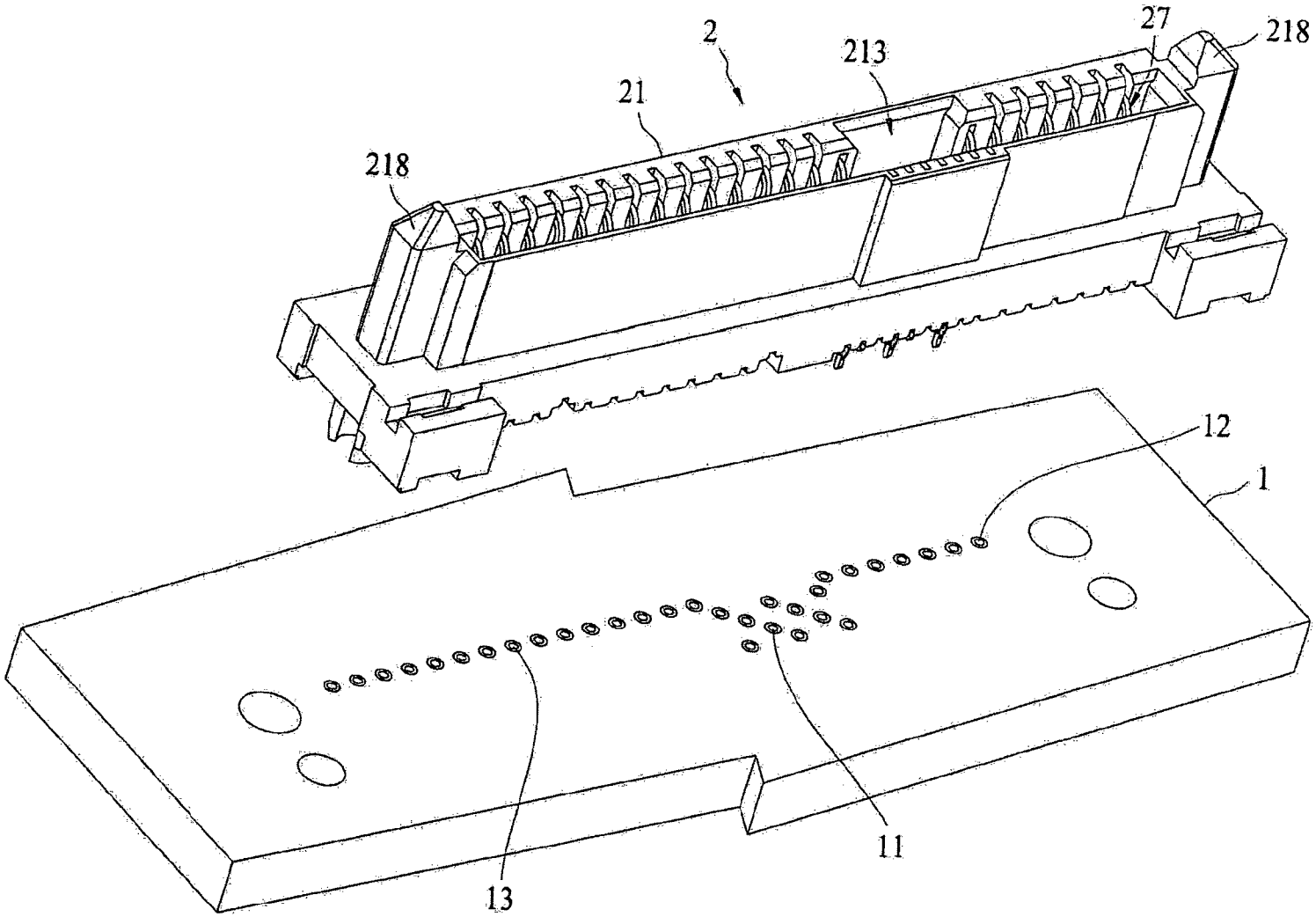
FIG. 3 is a schematic diagram showing an embodiment of the disclosure, illustrating an electric connector and a circuit board.
Figure 4:
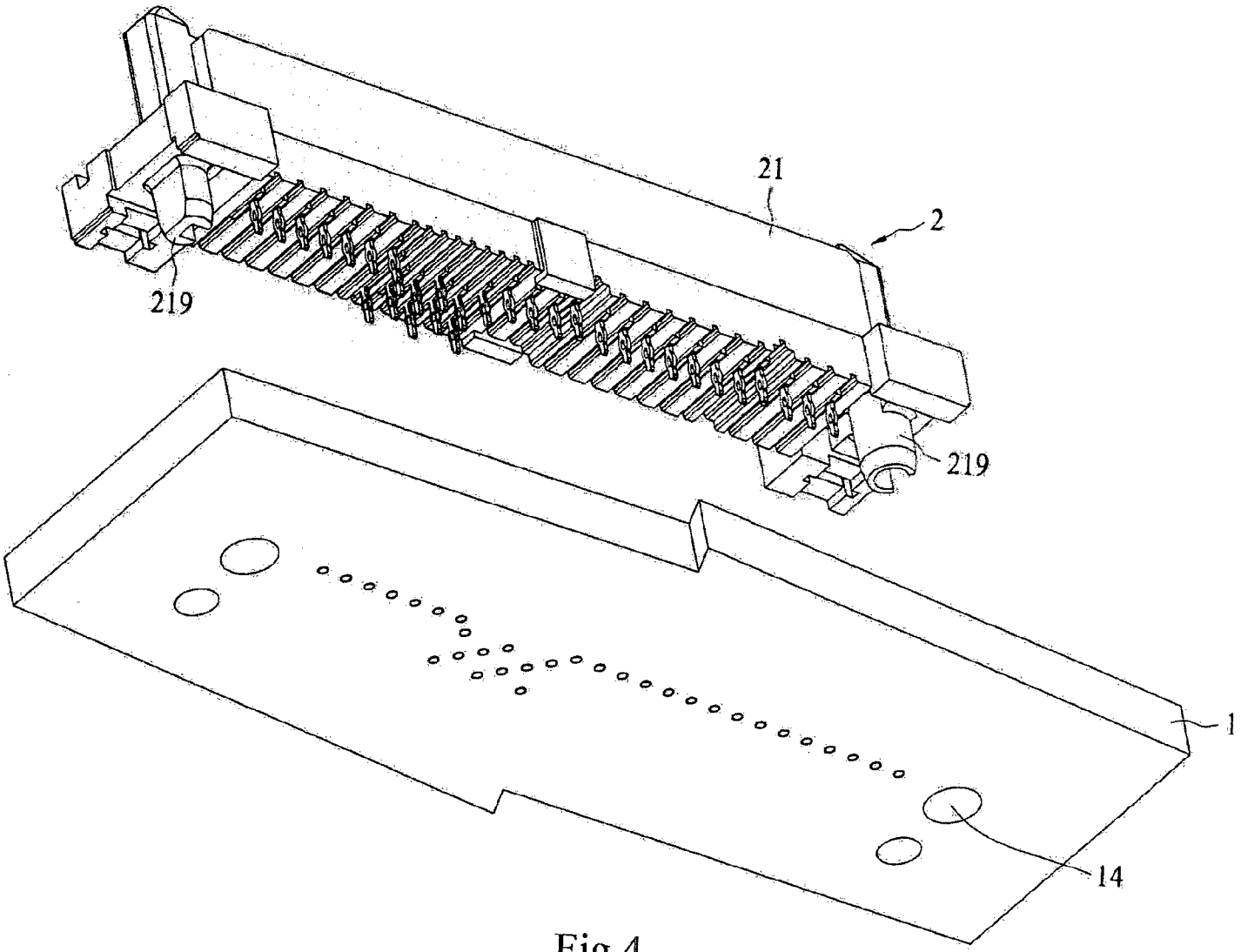
FIG. 4 is a schematic diagram showing an embodiment of the disclosure, illustrating the bottom surfaces of a circuit board and an electric connector.
Figure 5:
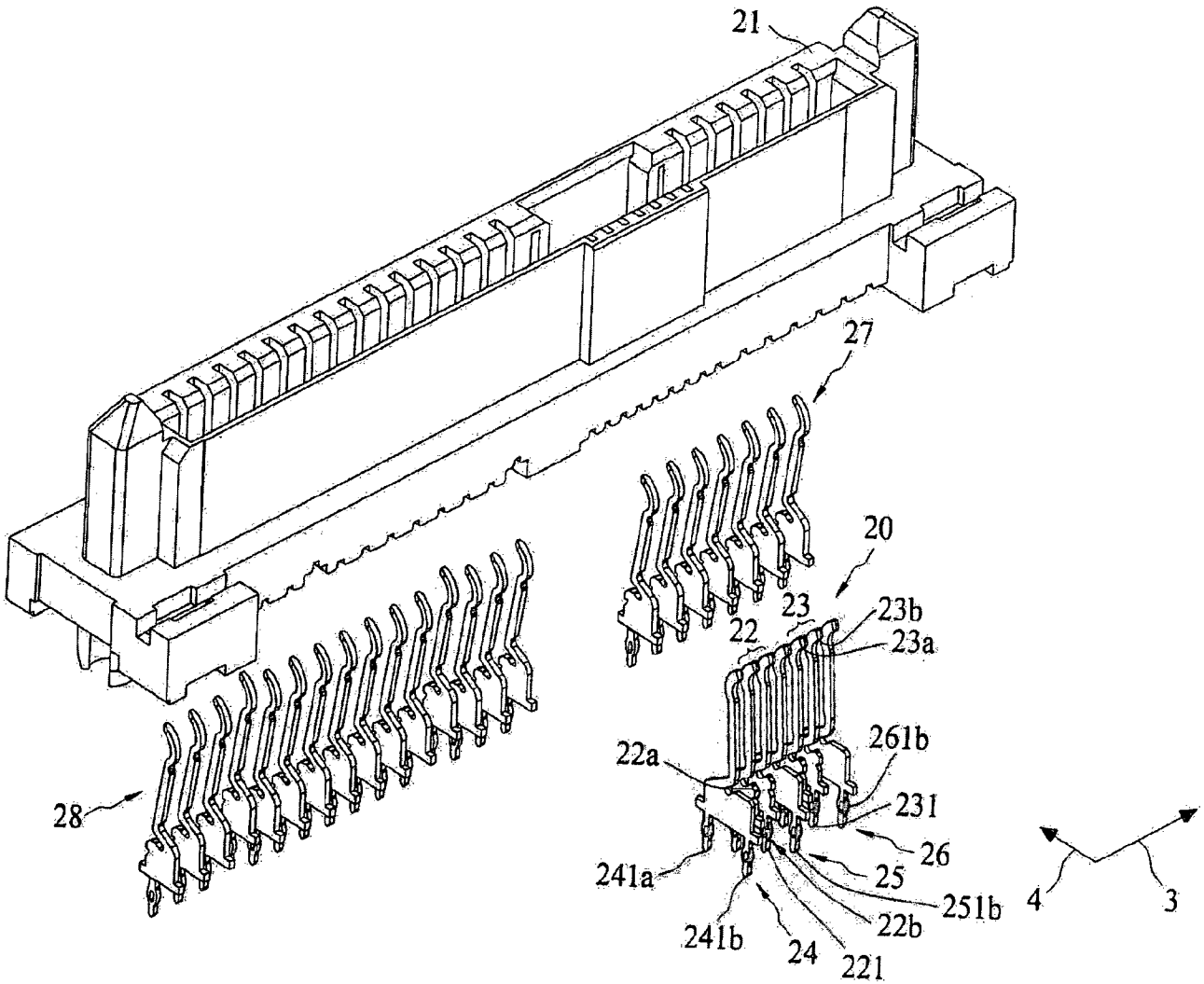
FIG. 5 is an exploded diagram showing an electric connector in an embodiment of the disclosure.
Figure 6:
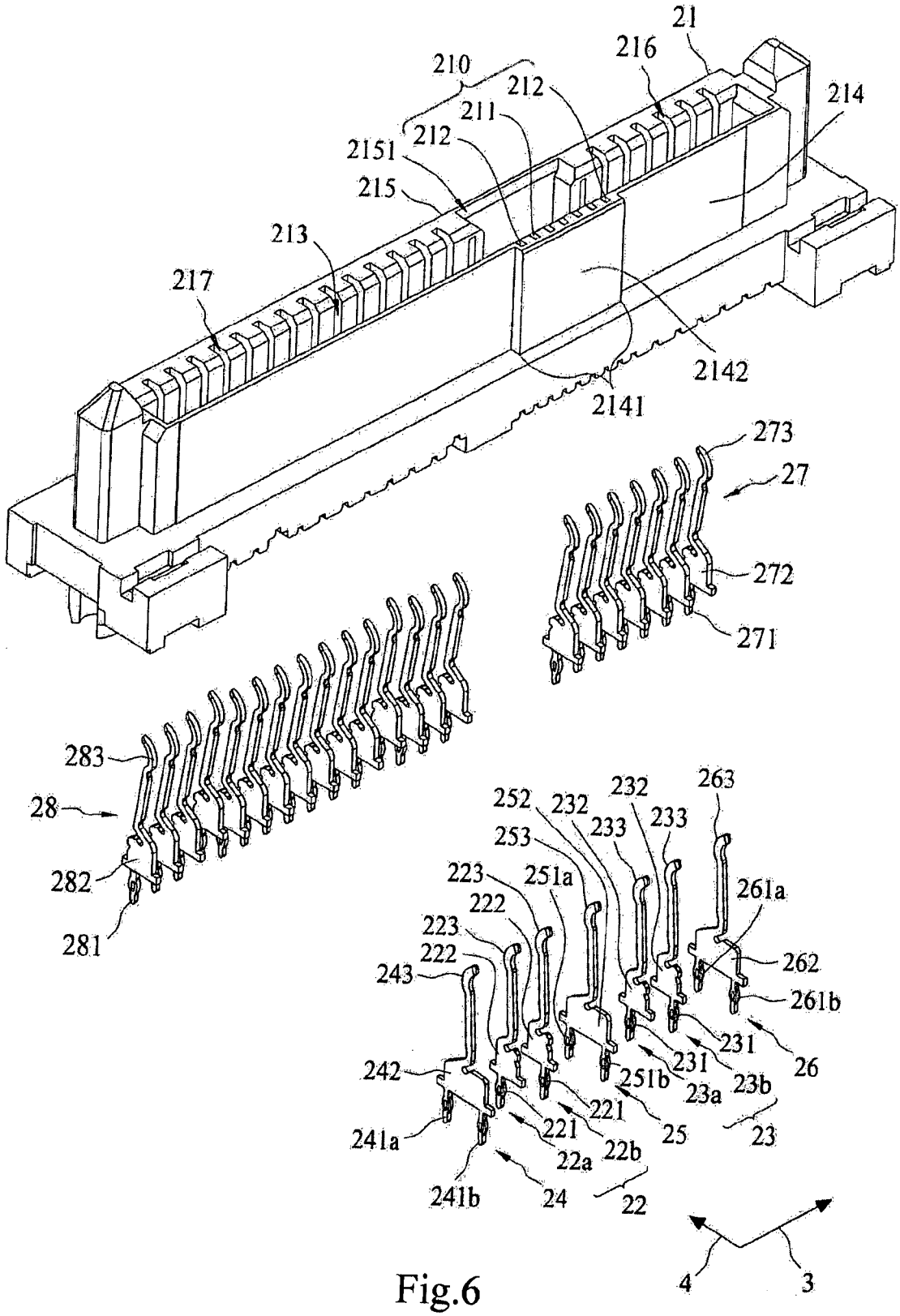
FIG. 6 is another exploded diagram showing an electric connector in an embodiment of the disclosure.

FIG. 1 is a schematic diagram showing an embodiment of the disclosure, illustrating an electric connector 2 installed on a circuit board 1. FIG. 2 is another schematic diagram showing an embodiment of the disclosure, illustrating an electric connector 2 installed on a circuit board 1. FIG. 3 is a schematic diagram showing an embodiment of the disclosure illustrating an electric connector 2 and a circuit board 1. FIG. 4 is a schematic diagram showing an embodiment of the disclosure, illustrating bottom surfaces of a circuit board 1 and an electric connector 2. FIG. 5 is an exploded diagram showing an electric connector 2 in an embodiment of the disclosure. FIG. 6 is another exploded diagram showing an electric connector 2 in an embodiment of the disclosure.

As shown in FIGS. 1-6, an electric connector 2 may be installed on a circuit board 1. The electric connector 2 may include an insulating body 21 and a first set of terminals 20. The first set of terminals 20 includes a first pair of differential signal terminals 22, a second pair of differential signal terminals 23, a first ground terminal 24, a second ground terminal 25 and a third ground terminal 26. The first pair of differential signal terminals 22 is disposed between the first ground terminal 24 and the second ground terminal 25, and the second pair of differential signal terminals 23 is disposed between the second ground terminal 25 and the third ground terminal 26.

Also there are another two sets of terminals (27 and 28) shown in the embodiment of FIGS. 1-6, the disclosure is not limited to have three sets of terminals (20, 27 and 28) in an embodiment. The disclosure can be applied to an electric connector having at least a first set of terminals 20, and the first set of terminals 20 includes the first pair of differential signal terminals 22, the second pair of differential signal terminals 23, the first ground terminal 24, the second ground terminal 25 and the third ground terminal 26.

The first pair of differential signal terminals 22 may be fixed at the insulating body 21. The first pair of differential signal terminals 22 may be used to transmit differential signals. The first pair of differential signal terminals 22 may include a first signal terminal 22*a* and a second signal terminal 22*b*. The first signal terminal 22*a* and the second signal terminal 22*b* may include a pin 221, respectively. In an embodiment, the first signal terminal 22*a* and the second signal terminal 22*b* may be press-fit type terminals, namely, the pins 221 of the first signal terminal 22*a* and the second signal terminal 22*b* include an eye of needle, respectively. When the electric connector 2 is mounted on the circuit board 1, the pins 221 of the first signal terminal 22*a* and the second signal terminal 22*b* are inserted in the corresponding openings 11 as depicted in FIG. 3, and the eyes of needles may be fixed by interfering with the openings 11. In another embodiment, the pins 221 of the first signal terminal 22*a* and the second signal terminal 22*b* are welded in the corresponding openings 11 of the circuit board 1. In another embodiment, the pins 221 of the first signal terminal 22*a* and the second signal terminal 22*b* are bent and may be welded on the circuit board 1 by means of surface mount technology.

The second pair of differential signal terminals 23 may be fixed to the insulating body 21. The second pair of differential signal terminals 23 may be used to transmit differential signals. The second pair of differential signal terminals 23 may include a third signal terminal 23*a* and a fourth signal terminal 23*b*. The third signal terminal 23*a* and the fourth signal terminal 23*b* may include a pin 231, respectively. In an embodiment, the third signal terminal 23*a* and the fourth signal terminal 23*b* may be press-fit type terminals, namely, the pins 231 of the third signal terminal 23*a* and the fourth signal terminal 23*b* include an eye of needle, respectively. When the electric connector 2 is mounted on the circuit board 1, the pins 231 of the third signal terminal 23*a* and the fourth signal terminal 23*b* are inserted in the corresponding openings 11 as depicted in FIG. 3 and the eyes of needles may be fixed by interfering with the openings 11. In another embodiment, the pins 231 of the third signal terminal 23*a* and the fourth signal terminal 23*b* are welded in the corresponding openings 11 of the circuit board 1. In another embodiment, the pins 5 231 of the third signal terminal 23*a* and the fourth signal terminal 23*b* are bent and may be welded on the circuit board 1 by means of surface mount technology.

Figure 7:
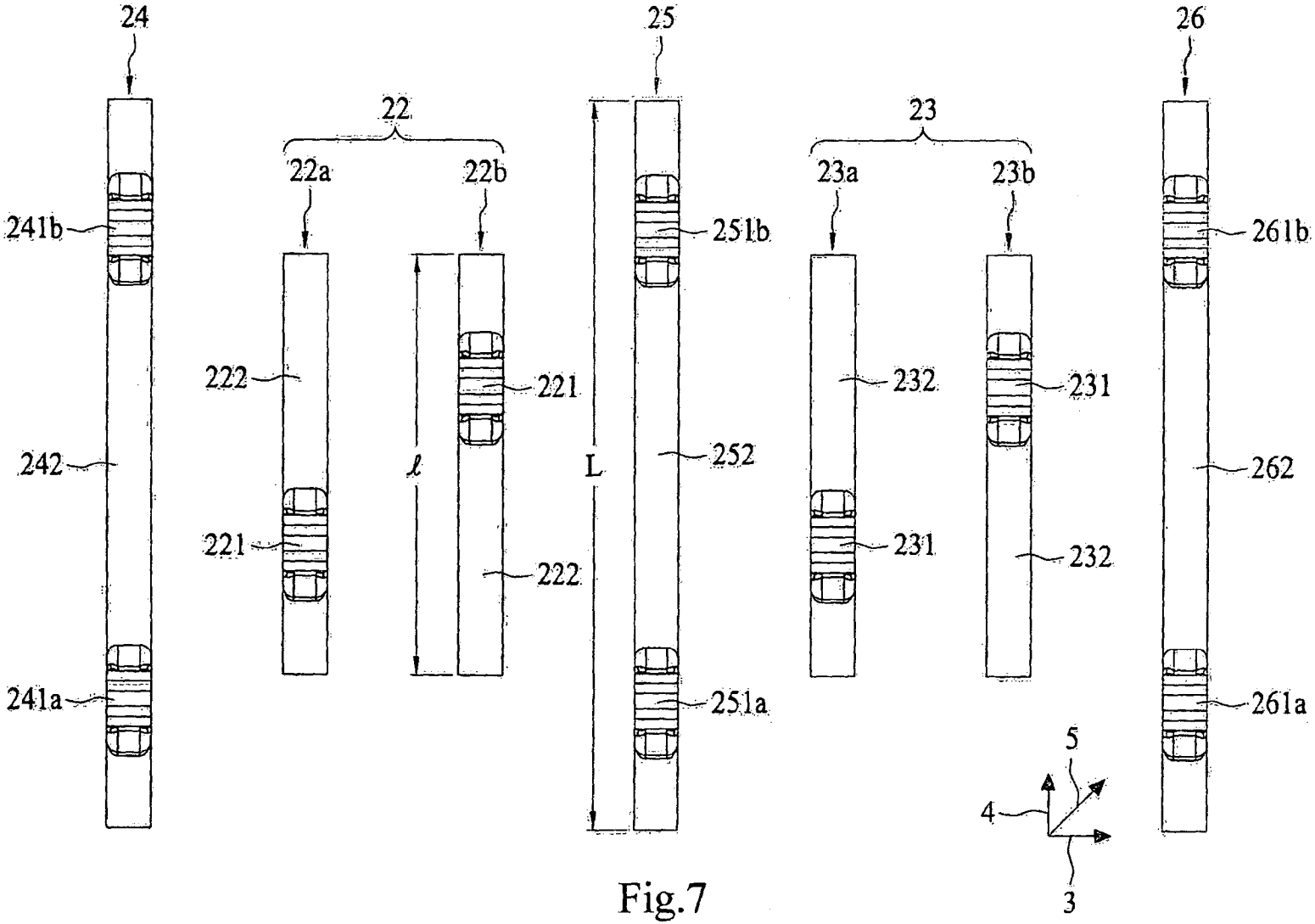
FIG. 7 is a schematic diagram showing the arrangement of ground terminals and signal terminals in an embodiment of the disclosure.

As shown in FIGS. 5-7, the first signal terminal 22*a*, the second signal terminal 22*b*, the third signal terminal 23*a* and the fourth signal terminal 23*b* may be arranged in a first direction 3 in sequence. In a second direction 4 transverse to the first direction 3, the two pins 221 of the first pair of differential signal terminals 22 are staggered, and the two pins 231 of the second pair of differential signal terminals 23 are staggered, as shown in FIG. 7.

As show in FIGS. 5-7, the first ground terminal 24 is arranged adjacent to the first signal terminal 22*a*. The first ground terminal 24 may include at least a pin (241*a* or 241*b*). In an embodiment, the pin 241*a* of the first ground terminal 24 is close to the pin 221 of the first 15 signal terminal 22*a*. The second ground terminal 25 is disposed between the second signal terminal 22*b* and the third signal terminal 23*a*.

The second ground terminal 25 includes a first pin 251*a*, a second pin 251*b* and a plate-shaped main body 252. The first pin 251*a* and the second pin 251*b* both may extend from the plate-shaped main body 252. In an embodiment, in the second signal terminal 22*b* and the third signal terminal 23*a*, the first pin 251*a* is closer to the pin 231 of the third signal terminal 23*a*, and the second pin 251*b* is closer to the pin 221 of the second signal terminal 22*b*.

The plate-shaped main body 252 of the second ground terminal 25 may separate the first pair of differential signal terminals 22 and the second pair of differential signal terminals 23, so as to reduce the cross-talking between the first pair of differential signal terminals 22 and the second pair of differential signal terminals 23. In an embodiment, as shown in FIG. 7, the size L of the plate-shaped main body 252 of the second ground terminal 25 in the second direction 4 is larger than the size 1 of the first pair of differential signal terminals 22 and the second pair of differential signal terminals 23 in the second direction 4, such that the cross-talking between the first pair of differential signal terminals 22 and the second pair of differential signal terminals 23 can be better prevented.

As shown in FIGS. 5-7, the third ground terminal 26 is arranged adjacent to the fourth signal terminal 23*b*. The third ground terminal 26 may include at least a pin (261*a* or 261*b*). In an embodiment, a pin 261*b* of the third ground terminal 26 is disposed close to the pin 231 of the fourth signal terminal 23*b*.

It should be noted that, the pin 241*a* of the first ground terminal 24 is closer to the pin 221 of the first signal terminal 22*a*, the first pin 251*a* of the second ground terminal 25 is closer to the pin 231 of the third signal terminal 23*a*, the second pin 251*b* of the second ground terminal 25 is closer to the pin 221 of the second signal terminal 22*b*, and the pin 261*b* of the third ground terminal 26 is close to the pin 231 of the fourth signal terminal 23*b*. Thus, the pin 221 of the first signal terminal 22*a* and the pin 241*a* of the first ground terminal 24 may have a stronger coupling effect, the pin 221 of the second signal terminal 22*b* and the second pin 251*b* of the second ground terminal 25 may have a stronger coupling effect, the pin 231 of the third signal terminal 23*a* and the first pin 251*a* of the second ground terminal 25 may have a stronger coupling effect, and the pin 231 of the fourth signal terminal 23*b* and the pin 261*b* of the third ground terminal 26 may have a stronger coupling effect. As a result, the electromagnetic interference between the first pair of differential signal terminals 22 and the second pair of differential signal terminals 23 is reduced.

As shown in FIG. 7, in an embodiment, the two pins 221 of the first pair of differential signal terminals 22 are disposed between the pin 241*a* of the first ground terminal 24 and the second pin 251*b* of the second ground terminal 25, and the two pins 231 of the second pair of 25 differential signal terminals 23 is disposed between the first pin 251*a* of the second ground terminal 25 and the pin 261*a* of the third ground terminal 26. In an embodiment; the pin 241*a* of first ground terminal 24, the two pins 221 of the first pair of differential signal terminals 22 and the second pin 251*b* of the second ground terminal 25 are arranged in a line along a diagonal direction 5. The first pin 251*a* of the second ground terminal 25, the two pins 231 of the second pair of differential signal terminals 23 and the terminal 261*b* of the third ground terminal 26 are arranged in a line along a diagonal direction 5. Such arrangement will obtain a better transmission effect.

As shown in FIG. 6, in an embodiment, the first ground terminal 24 may include a plate-shaped main body 242 and two pins (241*a* and 241*b*). The two pins (241*a* and 241*b*) extend from the plate-shaped main body 242. The two pins 241*a* and 241*b* are connected to the ground so as to reduce the equivalent inductance and then further reduce the electromagnetic interference generated by the first pair of differential signal terminals 22. In an embodiment, the size of the plate-shaped main body 242 in the second direction 4 is larger than the sizes of the first pair of differential signal terminals 22 and the second pair of differential signal terminals 23 in the second direction 4. In another embodiment, the first ground terminal 24 does not have the plate-shaped main body.

In an embodiment, the third ground terminal 26 may include a plate-shaped main body 262 and two pins (261*a* and 261*b*). The two pins (261*a* and 261*b*) extend from the plate-shaped main body 262. The two pins 261*a* and 261*b* are connected to the ground so as to reduce the equivalent inductance and then further reduce the electromagnetic interference generated by the second pair of differential signal terminals 23. In an embodiment, the size of the plate-shaped main body 262 in the second direction 4 is larger than the sizes of the first pair of differential signal terminals 22 and the second pair of differential signal terminals 23 in the second direction 4. In another embodiment, the third ground terminal 26 does not have the plate-shaped main body.

As shown in FIG. 6, a first set of terminal slots 210 is formed on the insulating body 21. The first set of terminal slots 210 may include a plurality of signal terminal slots 211. The signal terminal slots 211 correspond to the first signal terminal 22*a*, the second signal terminal 22*b*, the third signal terminal 23*a* and the fourth signal terminal 23*b*. The first signal terminal 22*a*, the second signal terminal 22*b*, the third signal terminal 23*a* and the fourth signal terminal 23*b* include a fixing portion (222 or 232), respectively. When the first signal terminal 22*a*, the second signal terminal 22*b*, the third signal terminal 23*a* or the fourth signal terminal 23*b* is assembled in the corresponding signal terminal slot 211, the fixing portion (222 or 232) interferes with the slot wall of the signal terminal slot 211 and is fixed in the signal terminal slot 211, so as to fix the first signal terminal 22*a*, the second signal terminal 22*b*, the third signal terminal 23*a* or the fourth signal terminal 23*b* on the insulating body 21.

In an embodiment, the size L of the plate-shaped main body 252 of the second ground terminal 25 in the second direction 4 is larger than the size of the fixing portion (222 or 232) in the second direction 4. In an embodiment, the size of plate-shaped main body 242 of the first ground terminal 24 in the second direction 4 is larger than the size of the fixing portion (222 or 232) in the second direction 4. In an embodiment, the size of the plate-shaped main body 262 of the third ground terminal 26 in the second direction 4 is larger than the size of the fixing portion (222 or 232) in the second direction 4.

Figure 8:
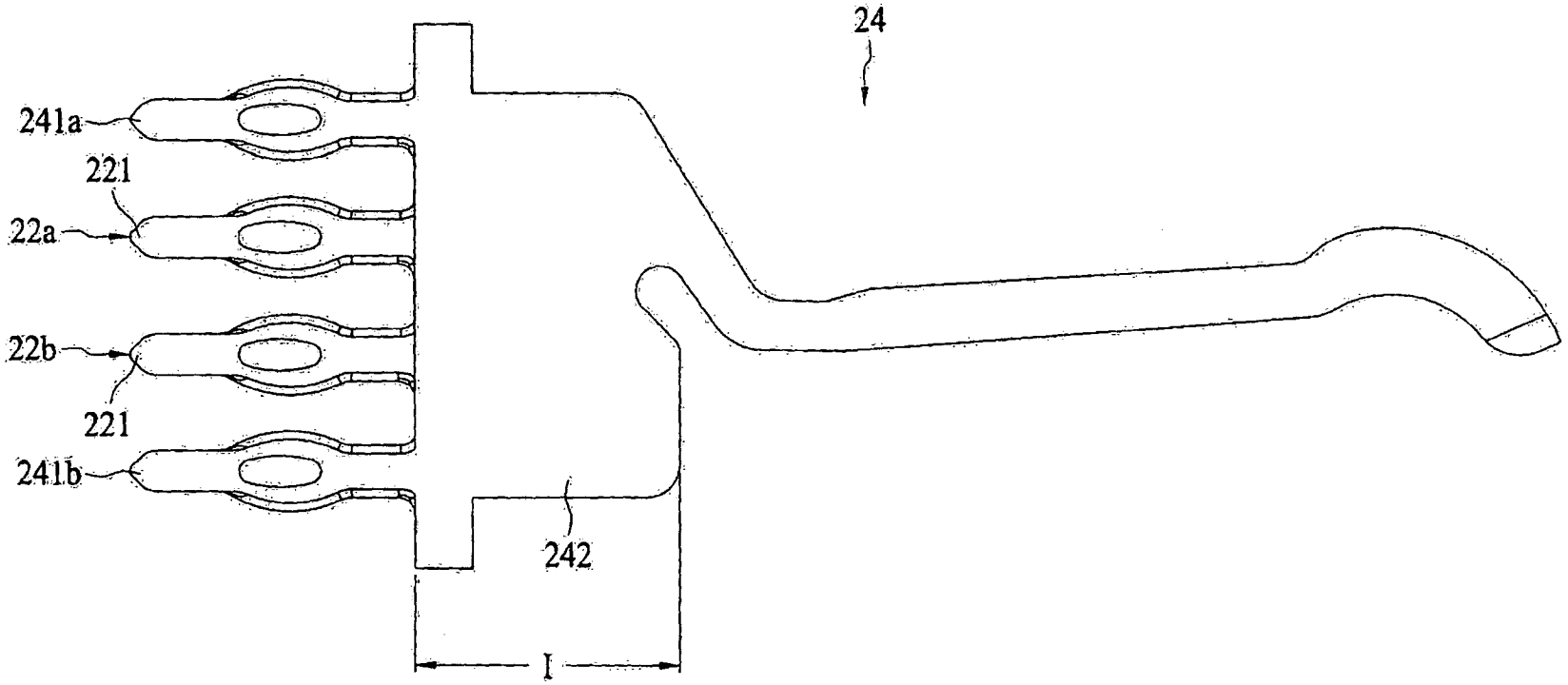
FIG. 8 is a side view of FIG. 7.

As shown in FIG. 8, the plate-shaped main body (242, 252 and 262) may be larger than the fixing portion (222 and 232). If the size of the plate-shaped main body (242, 252 or 262) in the second direction 4 is called the width and the size transverse to the width is called the height, besides the widths of the plate-shaped main body 242, the plate-shaped main body 252 and the plate-shaped main body 262 are larger than the width of the fixing portion (222 and 232), the heights I of the plate-shaped main body 242, the plate-shaped main body 252 and the plate-shaped main body 262 are not less than the height of the fixing portion (222 and 232), such that the electromagnetic interference is reduced.

As shown in FIG. 6, in the embodiment, the first set of terminal slots 210 further includes a plurality of ground terminal slots 212. The plurality of ground terminal slots 212 correspond to the first ground terminal 24, the second ground terminal 25 and the third ground terminal 26. When the first ground terminal 24, the second ground terminal 25 or the third ground terminal 26 is assembled to the corresponding ground terminal slot 212, the plate-shaped main body (242, 252 or 262) of the first ground terminal 24, the second ground terminal 25 or the third ground terminal 26 may interfere with the slot wall of the ground terminal slot 212.

As shown in FIG. 6, the insulating body 21 is formed with an inserting slot 213, and the inserting slot 213 may be used to insert a butting connector. The first signal terminal 22*a*, the second signal terminal 22*b*, the third signal terminal 23*a* and the fourth signal terminal 23*b* each include a contacting portion (223 or 233), respectively. After the first signal terminal 22*a*, the second signal terminal 22*b*, the third signal terminal 23*a* and the fourth signal terminal 23*b* are assembled in the corresponding signal terminal slots 211, the contacting portions (223 and 233) protrude into the inserting slots 213 as shown in FIG. 1 and are electrically connected to the inserted mating connector. In addition, the first ground terminal 24, the second ground terminal 25 and the third ground terminal 26 each include a contacting portion (243, 253 and 263), respectively. When the first ground terminal 24, the second ground terminal 25 and the third ground terminal 26 are fixed to the insulating body 21, the contacting portions (243, 253 and 263) protrude into the inserting slots 213.

As shown in FIG. 6, in an embodiment, the electric connector 2 may include a second set of terminals 27. The second set of terminals 27 may be fixed to the insulating body 21 and used for signal transmission.

The insulating body 21 includes a first side wall 214 and a second side wall 215. The first side wall 214 and the second side wall 215 extend along the first direction 3 and are located at two opposite sides of the inserting slot 213, respectively, for defining the inserting slot 213. The first set of terminal slots 210 may be formed on a first side wall 214. Further, the insulating body 21 may be formed with a second set of terminal slots 216, and the second set of terminal slots 216 corresponds to the second set of terminals 27. After the second set of terminals 27 are assembled in the second set of terminal slots 216, the terminal fixing portions 272 of the second set of terminals 27 interfere with the slot walls of the second set of terminal slots 216 so as to fix the second set of terminals 27 to the second set of terminal slots 216. In an embodiment, the second set of terminal slots 216 may be formed on the second side wall 215.

As shown in FIG. 2 and FIG. 6, each of the second set of terminals 27 includes a contacting portion 273. After the second set of terminals 27 is assembled in the corresponding second set of terminal slots 216, the contacting portions 273 protrude into the inserting slots 213 to electrically connect with the inserted mating connector.

As shown in FIG. 3 and FIG. 6, each of the second set of terminals 27 includes a pin 271. The pin 271 is used to electrically connect with the circuit board 1. In an embodiment, the circuit board 1 includes a plurality of openings 12, and the plurality of openings 12 correspond to the terminal pins 271 of the second set of terminals 27. Each pin 271 of the second set of terminals 27 includes an eye of needle. The eye of needle interferes and matches with the opening 12. In an embodiment, the circuit board 1 includes a plurality of openings 12, and the plurality of openings 12 correspond to the pins 271 of the second set of terminals 27. The pins 271 of the second set of terminals 27 are fixed to the corresponding openings 12 by welding. In an embodiment, the pins of the second set of terminals 27 are bent and may be welded on the circuit board 1 by means of surface mount technology.

In an embodiment, the pins 271 of the second set of terminals 27 may arranged in a line. In an embodiment, one part of pins 271 of the second set of terminals 27 are staggered with the other part of pins 271 of the second set of terminals 27 in the second direction 4.

As shown in FIG. 6, the electric connector 2 may include a third set of terminals 28. The third set of terminals 28 may be fixed to the insulating body 21, for electric power transmission.

A third set of terminal slots 217 may be formed on the second side wall 215 of the insulating body 21. The third set of terminal slots 217 corresponds to the third set of terminals 28. Each of the third set of terminals 28 may include a fixing portion 282. The fixing portions 282 of the third set of terminals 28 may interfere and match with the third set of terminal slots 217 correspondingly so as to fix the assembled third set of terminals 28. Each terminal 28 of the third set of terminals 28 includes a contacting portion 283. When the third set of terminals 28 is assembled in the third set of terminal slots 217, the contacting 5 portions 283 may protrude into the inserting slots 213 so as to electrically connect with and insert into the mating connector.

As shown in FIG. 3 and FIG. 6, each of the third set of terminals 28 includes a pin 281, and the pin 281 is used to electrically connect with the circuit board 1. In an embodiment, the circuit board 1 includes a plurality of openings 13. The plurality of openings 13 correspond to the pins 281 of the third set of terminals 28, respectively. Each terminal 281 of the third set of terminals 28 includes an eye of needle, and the eye of needle interferes with the openings 13. In an embodiment, the circuit board 1 includes a plurality of openings 13, the plurality of openings 13 correspond to the pins of the third set of terminals 28, respectively. The pins 281 of the third set of terminals 28 are fixed to the corresponding openings 13 by welding. In an embodiment, the pins of the third set of terminals 28 are bent and may be welded to the circuit board 1 by means of surface mount technology.

In an embodiment, the pins 281 of the third set of terminals 28 may be arranged in a line. In an embodiment, one part of pins 281 of the third set of terminals 28 are staggered with the other part of pins 281 of the third set of terminals 28 in the second direction 4.

As shown in FIG. 6, in an embodiment, the first side wall 214 includes a section 2141. Except for the section 2141 formed with the first set of terminal slots 210, the rest of the first side wall 214 has a thin thickness. In an embodiment, the section 2141 includes an outward-protrusion portion 2142, and the first set of terminal slots 210 is formed at the outward-protrusion portion 2142.

A recess portion 2151 may be formed on the second side wall 215 of the insulating body 21. The recess portion 2151 may be formed next to the inserting slots 213. The recess portion 2151 may be formed relative to the section 2141. In an embodiment, the recess portion 2151 may be used to prevent the mating connector from being inserted incorrectly. In an embodiment, the recess portion 2151 separates the second set of terminal slots 216 and the third set of terminal slots 217.

As shown in FIG. 3, the insulating body 21 is elongated and includes two ends. The inserting slots 213 are formed on the upper surface of the insulating body 21. A guiding block 218 is formed on each end of the insulating body 21. The guiding blocks 218 are close to the two ends of the inserting slot 213. The guiding block 218 is used to guide the mating connector when mating to the mating connector.

As shown in FIG. 4, the insulating body 21 includes two positioning pillars 219. The two positioning pillars 219 extend downwards from the bottom of the insulating body 21. Corresponding positioning holes 14 are formed on the circuit board 1. When the electric connector 2 is installed on the circuit board 1, the positioning pillars 219 are inserted into the corresponding positioning holes 14.

In an embodiment of the disclosure, the electric connector includes a first ground terminal, a first pair of differential signal terminals, a second ground terminal, a second pair of differential signal terminals and a third ground terminal, wherein the first pair of differential signal terminals is disposed between the first ground terminal and the second ground terminal, and the second pair of differential signal terminals is disposed between the second ground terminal and the third ground terminal. The first pair of differential signal terminals includes a first signal terminal and a second signal terminal, wherein the first signal terminal is close to the first ground terminal, and the second signal terminal is close to the second ground terminal. The second pair of differential signal terminals includes a third signal terminal and a fourth signal terminal, wherein the third signal terminal is close to the second ground terminal and the fourth signal terminal is close to the third ground terminal. The first ground terminal has a pin, and the pin of the first ground terminal is close to the pin of the first signal terminal. The second ground terminal includes two pins, one pin of which is close to the pin of the second signal terminal, and the other of which is close to the pin of the third signal terminal. The third ground terminal has a pin, and the pin of the third ground terminal is close to the pin of the fourth signal terminal. Since each pin of each pair of differential signal terminals is close to the pin of the adjacent ground terminal, the electromagnetic interference generated by each pair of differential signal terminals can be reduced. In addition, the second ground terminal includes a plate-shaped main body, and the plate-shaped main body may reduce the cross-talking between the first pair of differential signal terminals and the second pair of differential signal terminals. Also, the first ground terminal and the third ground terminal each have two pins, respectively, such that the equivalent inductance of the first ground terminal and the third ground terminal may be reduced, and the electromagnetic interference generated by each pair of differential signal terminals may be further reduced.

Technical content and technical characteristic of the present disclosure have been illustrated above, those skilled in the art, however, are still possible to have a variety of substitutions and modifications based on the disclosure and teachings of the present disclosure without departing from the spirit of this disclosure. Thus, the scope of the present disclosure should not be limited to the exemplary embodiments, but rather should be construed to include various substitutions and modifications without departing from the disclosure, and fall within the scope of the appended claims.

What is claimed is:

1. An electric connector comprising:

an insulating body; and a first set of terminals including:

a first pair of differential signal terminals fixed on the insulating body, the first pair of differential signal terminals including a first signal terminal and a second signal terminal, each of the first signal terminal and the second signal terminal including a pin;

a second pair of differential signal terminals fixed to the insulating body, the second pair of differential signal terminals including a third signal terminal and a fourth signal terminal, each of the third signal terminal and the fourth signal terminal including a pin, wherein the first signal terminal, the second signal terminal, the third signal terminal and the fourth signal terminal are arranged in a first direction in sequence, and the pins of the first terminal are staggered in a second direction transverse to the first direction to the second terminal and the pins of the third terminal are staggered in a second direction transverse to the first direction to the fourth terminal;

a first ground terminal disposed adjacent to the first signal terminal, the first ground terminal including at least a pin, wherein the at least pin of the first ground terminal is close to the pin of the first signal terminal;

a second ground terminal disposed between the second signal terminal and the third signal terminal, the second ground terminal including a first pin and a second pin, in which the first pin is close to the pin of the third signal terminal and the second pin is close to the pin of the second ground terminal; and a third ground terminal, disposed adjacent to the fourth signal terminal, the third ground terminal including at least a pin, wherein the at least a pin of the third ground terminal is close to the pin of the fourth signal terminal; and wherein the insulating body includes a first set of terminal slots and the first set of terminals is fixed to the first set of terminal slots correspondingly, the insulating body further includes a first side wall and a second side wall, the first side wall and the second side wall extend along the first direction and define an inserting slot, and the first set of terminal slots is formed on the first side wall, the first side wall has a section including an outward-protrusion portion, and the first set of terminal slots is formed at the section.

2. The electric connector according to claim 1, wherein the second ground terminal comprises a plate-shaped main body, the first pin and the second pin of the second ground terminal extend from the plate-shaped main body, the size of the plate-shaped main body in the second direction is larger than the sizes of the first pair of differential signal terminals and the second pair of differential signal terminals in the second direction.

3. The electric connector according to claim 2, wherein the first ground terminal comprises a plate-shaped main body and two pins, and the third ground terminal comprises a plate-shaped main body and two pins.

4. The electric connector according to claim 1, further comprising a second set of terminals, wherein the second side wall includes a second set of terminal slots and the second set of terminals is fixed to the second set of terminal slots correspondingly.

5. The electric connector according to claim 4, further comprising a third set of terminals, wherein the second side wall includes a third set of terminal slots and the third set of terminals is fixed to the third set of terminal slots correspondingly.

6. The electric connector according to claim 5, wherein the second side wall comprises a recess portion and the recess portion separates the second set of terminal slots and the third set of terminal slots.

7. The electric connector according to claim 1, wherein the at least a pin of the first ground terminal, the pins of the first pair of differential signal terminals and the second pin of the second ground terminal are arranged in a line along a diagonal direction.

8. The electric connector according to claim 1, wherein the first pin of the second ground terminal, the pins of the second pair of differential signal terminals and the at least a pin of the third ground terminal are arranged in a line along a diagonal direction.

9. The electric connector according to claim 1, wherein a distance between the first pin and second pin of the second ground terminal in the second direction is larger than a distance between the pins of the first pair of differential signal terminals and the pins of the second pair of differential signal terminals in the second direction.

* * * * *